US011873186B2

(12) United States Patent
Hagihara

(10) Patent No.: US 11,873,186 B2
(45) Date of Patent: Jan. 16, 2024

(54) DOCUMENT CONVEYANCE DEVICE, IMAGE READING DEVICE AND IMAGE FORMING APPARATUS

(71) Applicant: KYOCERA Document Solutions Inc., Osaka (JP)

(72) Inventor: Hirofumi Hagihara, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 147 days.

(21) Appl. No.: 17/547,453

(22) Filed: Dec. 10, 2021

(65) Prior Publication Data

US 2022/0185606 A1 Jun. 16, 2022

(30) Foreign Application Priority Data

Dec. 16, 2020 (JP) ..... 2020-208477

(51) Int. Cl.

| | |
|---|---|
| ***B65H 7/02*** | (2006.01) |
| ***B65H 31/10*** | (2006.01) |
| ***B65H 1/18*** | (2006.01) |
| ***B65H 1/14*** | (2006.01) |
| ***B65H 29/50*** | (2006.01) |

(52) U.S. Cl.

CPC ..... *B65H 7/02* (2013.01); *B65H 1/14* (2013.01); *B65H 1/18* (2013.01); *B65H 29/50* (2013.01); *B65H 31/10* (2013.01); *B65H 2405/3321* (2013.01); *B65H 2511/15* (2013.01)

(58) Field of Classification Search

CPC ... B65H 1/08; B65H 1/14; B65H 1/18; B65H 7/02; B65H 7/04; B65H 7/14; B65H 7/20; B65H 29/50; B65H 43/02; B65H 43/06; B65H 43/08; B65H 2404/142; B65H 2404/1421; B65H 2405/3321; B65H 2511/15

See application file for complete search history.

(56) References Cited

U.S. PATENT DOCUMENTS

| | | | | |
|---|---|---|---|---|
| 10,737,896 | B2 * | 8/2020 | Ito | H04N 1/00615 |
| 2019/0233225 | A1 * | 8/2019 | Ito | H04N 1/00615 |
| 2019/0306352 | A1 * | 10/2019 | Miwa | B65H 31/02 |
| 2021/0114834 | A1 * | 4/2021 | Tashiro | B65H 3/0684 |

FOREIGN PATENT DOCUMENTS

JP 2005-008283 A 1/2005

* cited by examiner

*Primary Examiner* — Prasad V Gokhale

(74) *Attorney, Agent, or Firm* — Studebaker & Brackett PC

(57) ABSTRACT

A document conveyance device includes a supply tray, a discharge tray, a conveyance part, a discharge part, and a lifting and lowering part. The lifting and lowering part lifts the supply tray and the discharge part according to a feeding of the document. When the feeding of the document to the document conveyance path is completed and then the supply tray is lifted, in a small number of documents discharge state where the height of the documents stacked on the discharge tray is less than the specified value, the lifting and lowering part positions the supply tray at a taking out position depart upward from the specified value by a predetermined space.

6 Claims, 10 Drawing Sheets

DOCUMENT CONVEYANCE DEVICE, IMAGE READING DEVICE AND IMAGE FORMING APPARATUS

INCORPORATION BY REFERENCE

This application is based on and claims the benefit of priority from Japanese patent application No. 2020-208477 filed on Dec. 16, 2020, which is incorporated by reference in its entirety.

BACKGROUND

The present disclosure relates to a document conveyance device, an image reading device and an image forming apparatus.

A document feeding device is known, which feeds a document from a document bundle placed on a sheet feeding tray one by one and discharges it on a document discharge tray. The document feeding device includes a lifting and lowering mechanism which lifts the sheet feeding tray from the lowermost position depending on a decrease in thickness of the document bundle placed on the sheet feeding tray. By lifting and lowering the sheet feeding tray, it becomes possible to increases a number of the documents placed on the sheet feeding tray.

In the document feeding device described above, after the feeding of the document is completed, the lifted sheet feeding tray is lowered to such a height where it does not interfere with the document on the document discharge tray. Therefore, in a case where a number of the documents on the document discharge tray is small, the sheet feeding tray is lowered almost the lowermost position. Then, because a space between the sheet feeding tray and the document discharge tray is narrow, it becomes difficult for a user to enter his hand into the space and to take out the document discharged on the document discharge tray.

SUMMARY

In accordance with an aspect of the present disclosure, a document conveyance device includes a supply tray, a discharge tray, a conveyance part, a discharge part, and a lifting and lowering part. On the supply tray, a document is placed. The discharge tray is disposed below the supply tray. The conveyance part feeds the document on the supply tray to a document conveyance path one by one and conveys the document along the document conveyance path. The discharge part discharges the document conveyed by the conveyance part to the discharge tray. The lifting and lowering part lifts and lowers the supply tray and the discharge part. The lifting and lowering part lifts the supply tray and the discharge part according to a feeding of the document. When the feeding of the document to the document conveyance path is completed and then the supply tray is lifted, in a large number of documents discharge state where a height of the documents stacked on the discharge tray is more than a specified value, the lifting and lowering part positions the supply tray at a height depart upward from an uppermost document of the documents stacked on the discharge tray by a predetermined space. When the feeding of the document to the document conveyance path is completed and then the supply tray is lifted, in a small number of documents discharge state where the height of the documents stacked on the discharge tray is less than the specified value, the lifting and lowering part positions the supply tray at a taking out position depart upward from the specified value by the predetermined space.

In accordance with an aspect of the present disclosure, an image reading device includes the document conveyance device and a reading part which reads an image of the document conveyed along the document conveyance path by the conveyance part.

In accordance with an aspect of the present disclosure, an image forming apparatus includes the image reading device.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
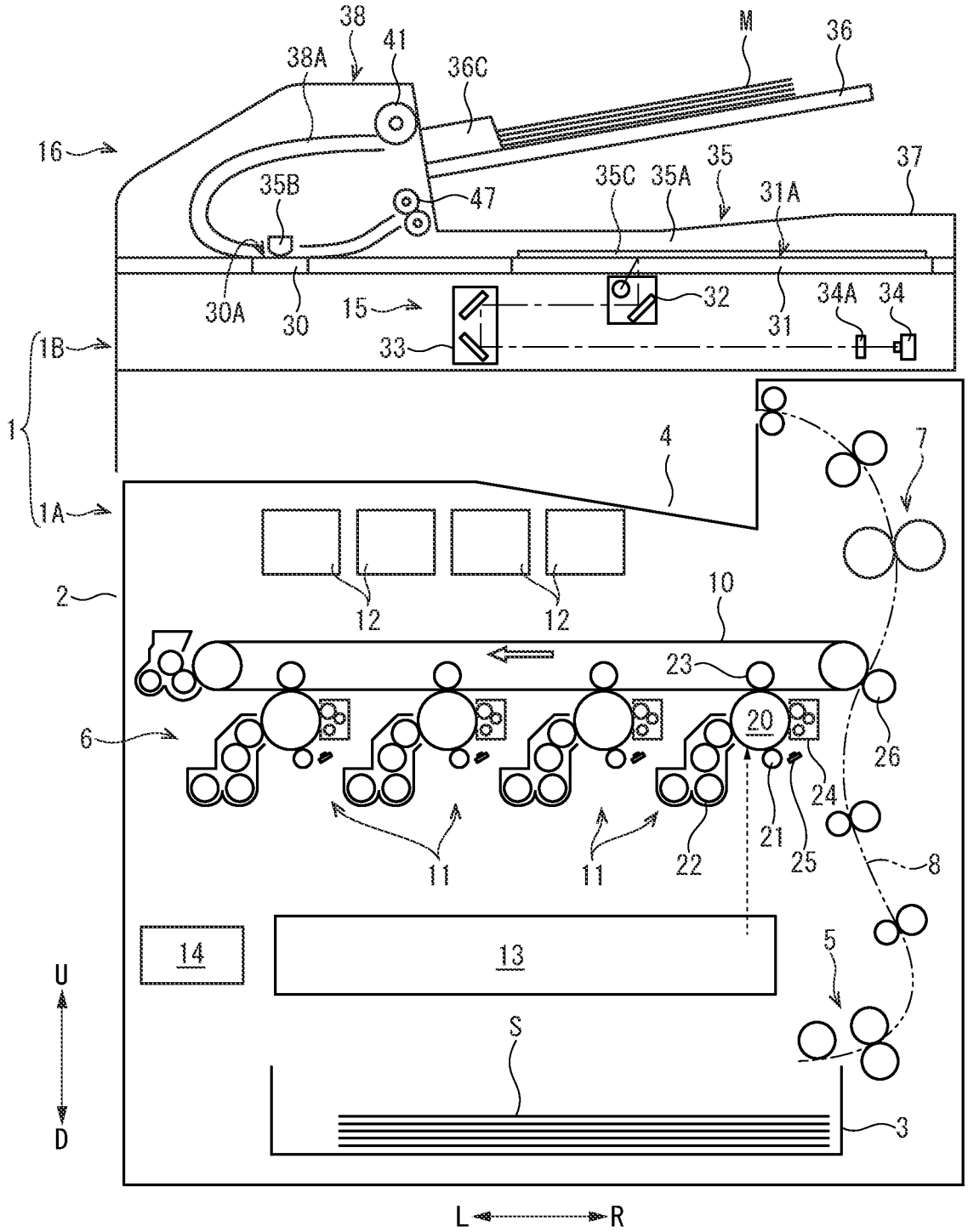
FIG. 1 is a front view schematically showing an inner structure of an image forming apparatus according to one embodiment of the present disclosure.

Hereinafter, with reference to the attached drawings, one embodiment of the present disclosure will be described. L, R, U and D in the drawings indicate left, right, upper and lower, and the front side of the drawing is defined as the front side. Although directional and positional terms are used in the specification, they are used for convenience of explanation and are not intended to limit the scope of the present disclosure.

With reference to FIG. 1, an image forming apparatus 1 will be described. FIG. 1 is a front view schematically showing an internal structure of the image forming apparatus 1.

[Outline of Image Forming Apparatus]

As shown in FIG. 1, the image forming apparatus 1 includes an image forming device 1A and an image reading device 1B. The image forming device 1A forms an image on a sheet S in an electrophotographic manner. The image reading device 1B optically reads an image of a document M and converts it into digital data. The image forming apparatus 1 includes a controller 14 which appropriately controls the image forming device 1A and the image reading device 1B.

[Image Forming Device]

In the lower portion of the device main body 2 of the image forming device 1A, a sheet feeding cassette 3 in which a bundle of the paper sheets S is stored is detachably attached. On the upper surface of the device main body 2, a discharge tray 4 on which the sheet S on which an image is formed is received is provided. The sheet S is not limited to the paper sheet, but may be a resin film or the like.

The image forming device 1A includes a sheet feeding part 5, an image forming part 6 and a fixing part 7 inside the device main body 2. The sheet feeding part 5 is disposed on the upstream side on a conveyance path 8 extending from the sheet feeding cassette 3 to the sheet discharge tray 4. The fixing part 7 is disposed on the downstream side on the conveyance path 8, and the image forming part 6 is disposed between the sheet feeding part 5 and the fixing part 7 on the conveyance path 8.

The image forming part 6 includes an intermediate transfer belt 10, four image forming units 11, four toner containers 12 and an exposure unit 13. The four image forming units 11 are disposed side by side in the left-and-right direction below the intermediate transfer belt 10. The exposure unit 13 is disposed below the image forming units 11. The four toner containers 12 are disposed above the intermediate transfer belt 10, and store toners (developers) of four colors (yellow, magenta, cyan and Black) for replenishment.

Each image forming unit 11 includes a photosensitive drum 20, a charge device 21, a development device 22, a primary transfer roller 23, a cleaning device 24 and a static eliminator 25. Since the four image forming units 11 have the same configuration, one image forming unit 11 will be described below.

The photosensitive drum 20 is driven to be rotated while coming into contact with the intermediate transfer belt 10. The charge device 21, the development device 22, the primary transfer roller 23, the cleaning device 24 and the static eliminator 25 are disposed around the photosensitive drum 20 in the order of the image forming process. The primary transfer roller 23 faces the photosensitive drum 20 across the intermediate transfer belt 10. A secondary transfer roller 26 comes into contact with the right side portion of the intermediate transfer belt 10.

Figure 3:
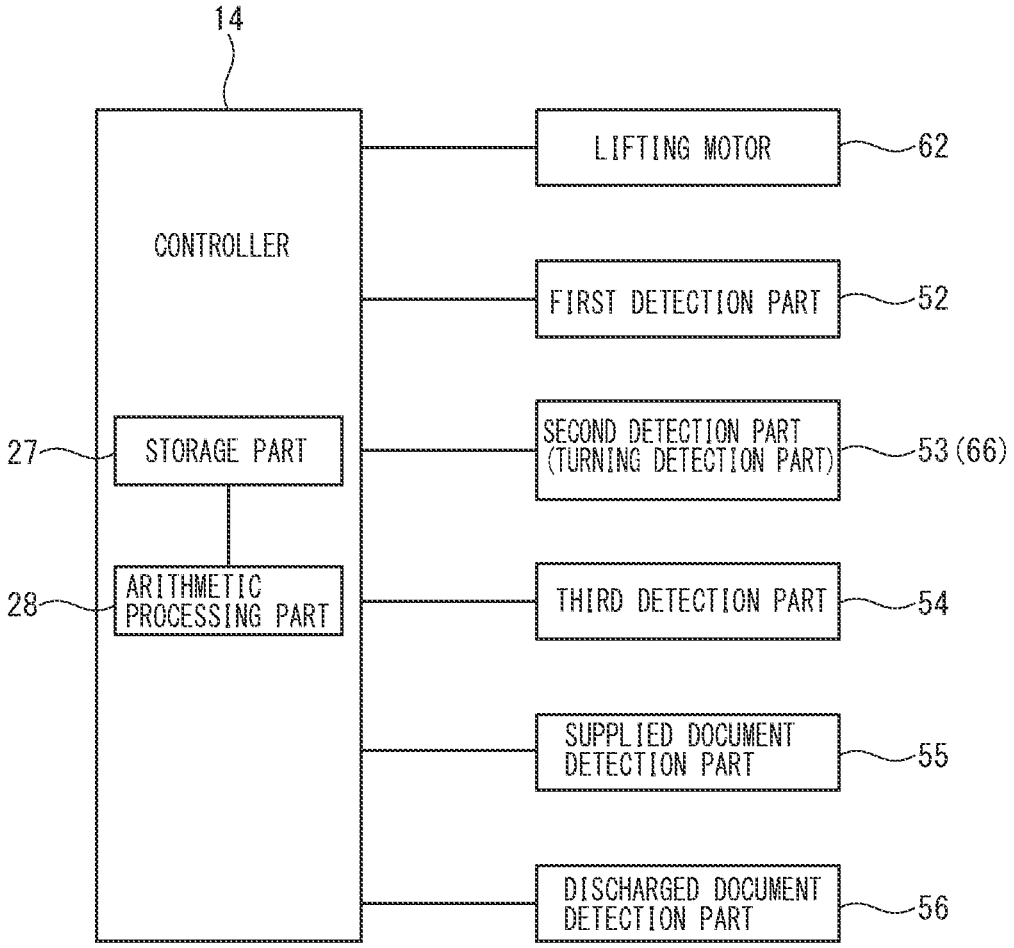
FIG. 3 is a block diagram showing a controller and the others of the document conveyance device according to the first embodiment of the present disclosure.

The controller 14 includes a storage part 27 which stores a program, data and the others, and an arithmetic processing part 28 which executes arithmetic processing according to the program and the others (see FIG. 3). Various devices of the image forming apparatus 1 are electrically connected to the controller 14, and the controller 14 overall controls the image forming apparatus 1.

[Image Formation Process]

An operation of the image forming device 1A will be described. The image forming device 1A forms the image on the sheet S based on the image data read by the image reading device 1B or image data transmitted from an external terminal (a personal computer or the like). The controller 14 controls the image forming device 1A based on the input image data to perform the image forming process in the following manner.

The charge device 21 charges the surface of the photosensitive drum 20. The exposure unit 13 exposures the photosensitive drum 20 corresponding to the image data to form an electrostatic latent image on the surface of the photosensitive drum 20. The development device 22 develops the electrostatic latent image on the photosensitive drum 20 into a toner image by using the toner supplied from the toner container 12. The toner images of the four colors carried on the four photosensitive drums 20 are primarily transferred in order to the intermediate transfer belt 10 by the primary transfer rollers 23 to which a primary transfer bias is applied. Thus, a full-color toner image is formed on the surface of the intermediate transfer belt 10.

On the other hand, the sheet feeding part 5 feeds the sheet S in the sheet feeding cassette 3 to the conveyance path 8. The secondary transfer roller 26 secondarily transfers the toner image on the intermediate transfer belt 10 to the sheet S passing between the secondary transfer toller 26 and the intermediate transfer belt 10. The fixing part 7 thermally fixes the toner image on the sheet S. Thereafter, the sheet S is discharged to the discharge tray 4. The cleaning device 24 removes the waste toner (the residual toner) remaining on the surface of the photosensitive drum 20 after the primary transferring. The static eliminator 25 irradiates the photosensitive drum 20 with static eliminator light to remove the charge of the photosensitive drum 20.

[Image Reading Device]

Next, the image reading device 1B will be described. As shown in FIG. 1, the image reading device 1B includes a reading part 15 and a document conveyance device 16. The reading part 15 reads the image of the document M conveyed along a document conveyance path 38A by a conveyance part 38 described below. The document conveyance device 16 is disposed above the reading part 15 and automatically sends the document M one by one to a document conveyance surface 30A.

<Reading Part>

The reading part 15 includes a contact glass 30, a platen glass 31, an optical scanning unit 32, a reflection unit 33 and an image sensor 34.

(Contact Glass, Platen Glass)

The contact glass 30 is provided on the left upper surface of the device main body 2, and constitutes the document conveyance surface 30A along which the document M is passed. The platen glass 31 is disposed on the right side of the contact glass 30, and constitutes a document placement surface 31A on which the document M is placed.

(Optical Scanning Unit)

The optical scanning unit 32 is stopped at a position facing the document conveyance surface 30A, and irradiates the document M being conveyed on the contact glass 30 with light. The optical scanning unit 32 irradiates the document M on the platen glass 31 (the document placement surface 31A) with the light while moving rightward in FIG. 1 from the position facing the document conveyance surface 30A.

(Reflection Unit)

The reflection unit 33 reflects the light irradiated from the optical scanning unit 32 and reflected on the document M toward a condenser lens 34A. When the optical scanning unit 32 irradiates the document M on the document placement surface 31A with the light, the reflection unit 33 moves in the same direction as the optical scanning unit 32 so as to keep an optical path length between the document M and the condenser lens 34A constant.

(Image Sensor) The image sensor 34 is a semiconductor element which photoelectrically converts the light received via the condenser lens 34A. The condenser lens 34A is disposed coincident with the light receiving part of the image sensor 34. The image sensor 34 and the condenser lens 34A are fixed to the housing of the reading part 15.

<Document Conveyance Device>

Figure 2:
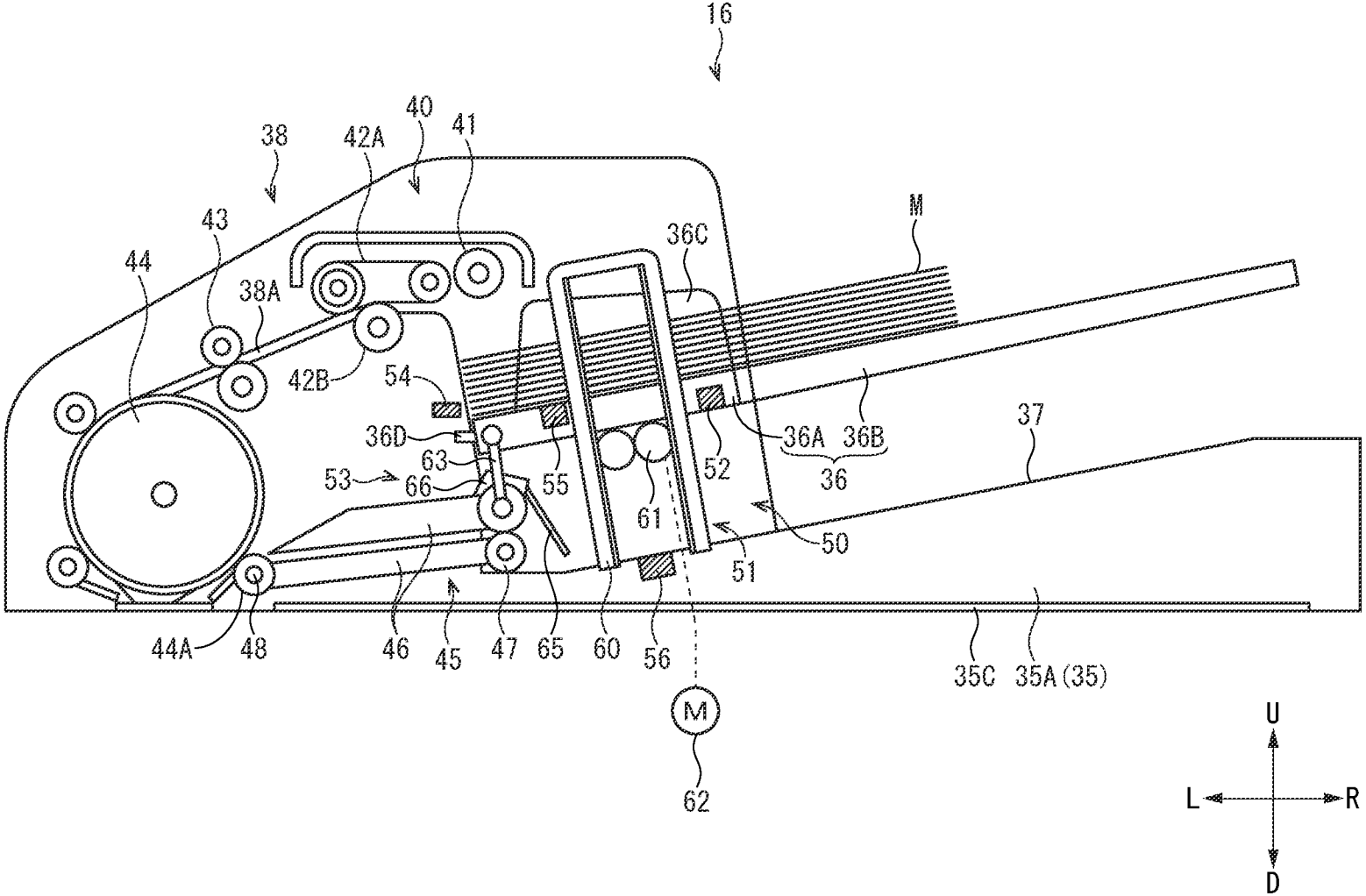
FIG. 2 is a sectional view showing a document conveyance device according to the first embodiment of the present disclosure.

Next, with reference to FIG. 1 and FIG. 2, the document conveyance device 16 according to the first embodiment will be described. FIG. 2 is a sectional view showing the document conveyance device 16.

As shown in FIG. 1, the document conveyance device 16 includes a document holding part 35, a supply tray 36, a discharge tray 37 and the conveyance part 38. Hereinafter, "upstream" and "downstream" respectively indicate an upstream and a downstream in a conveyance direction of the document M.

(Document Holding Part)

The document holding part 35 includes a holding part main body 35A, a holding member 35B and a holding plate 35C. The holding part main body 35A is formed so as to cover the glasses 30 and 31 of the reading part 15. The holding member 35B is provided on the lower surface of the holding part main body 35A so as to face the contact glass 30. The holding plate 35C is provided on the lower surface of the holding part main body 35A so as to face the platen glass 31.

The holding part main body 35A is attached to the upper rear surface of the device main body 2 of the image reading device 1A by a hinge (not shown). The holding part main body 35A is turnable (openable and closable) around the hinge. When the front side end portion of the holding part main body 35A is lifted (opened), the contact glass 30 (the document conveyance surface 30A) and the platen glass 31 (the document placement surface 31A) are exposed. The holding member 35B has a function of holding the document M being conveyed by the conveyance part 38 on the document conveyance surface 30A. The holding plate 35C has a function of holding the document M on the document placement surface 31A.

(Supply Tray)

As shown in FIG. 2, the supply tray 36 is formed so as to extend from the conveyance part 38 upward in the right oblique direction. The supply tray 36 is disposed depart upward from the holding part main body 35A. On the supply tray 36, the documents M (the bundle of the documents M) are placed. The supply tray 36 has a downstream side tray 36A disposed on the downstream side in the conveyance direction and an upstream side tray 36B disposed on the upstream side in the conveyance direction.

The downstream side tray 36A is provided with a pair of cursors 36C which aligns both front and rear edges of the placed documents M and aligns the center of the documents M in the width direction with the center of the supply tray 36 in the width direction. The downstream side tray 36A is provided with a supplied document detection part 55 which detects whether the document M is placed on the supply tray 36. The supplied document detection part 55 is constituted by, for example, a reflection type optical sensor, and is connected to the controller 14 via a predetermined circuit (not shown). The upstream side tray 36B is connected to the upstream end of the downstream side tray 36A in a turnable manner. When a user flips up the upstream side tray 36B as necessary, an upper space above the discharge tray 37 is opened, and the documents M can be easily taken out from the discharge tray 37.

(Discharge Tray)

The discharge tray 37 is disposed below the supply tray 36 and above the document holding part 35. Specifically, the upper surface of the holding part main body 35A disposed on the platen glass 31 is configured as the discharge tray 37 (see also FIG. 1). The discharge tray 37 receives the documents M conveyed to and discharged from the conveyance part 38. The discharge tray 37 is provided with a discharged document detection part 56 which detects the document M stacked on the discharge tray 37. The discharged document detection part 56 is constituted by, for example, a reflection type optical sensor, and is connected to the controller 14 via a predetermined circuit (not shown). The supplied document detection part 55 and the discharged document detection part 56 are not limited to the reflection type optical sensor, but may be a camera, a microswitch or the like.

(Conveyance Part)

As shown in FIG. 1, the conveyance part 38 is provided on the left side of the holding part main body 35A. In the conveyance part 38, the substantially U-shaped document conveyance path 38A is formed so as to connect the supply tray 36 to the discharge tray 37. The conveyance part 38 feeds the documents M on the supply tray 36 to the document conveyance path 38A one by one, and discharges the documents M passed through the document conveyance path 38A from a discharge part 45 to the discharge tray 37.

As shown in FIG. 2, in the conveyance part 38, a conveyance mechanism part 40 which supports the conveyance mechanism is provided. In the conveyance mechanism part 40, a pickup roller 41, a feed belt 42A, a separation roller 42B, a pair of registration rollers 43 and a conveyance roller 44 are supported in a rotatable manner around respective axes. The conveyance mechanism part 40 further includes the discharge part 45 which constitutes the downstream end portion of the document conveyance path 38A. A pair of discharge rollers 47 is supported in the discharge part 45 in a rotatable manner around axes. In the pair of registration rollers 43 and the pair of discharge rollers 47, one roller is driven to be rotated and the other roller is driven by the one roller to be rotated.

The pickup roller 41 is disposed above the upstream end portion of the document conveyance path 38A, comes into contact with the uppermost document M, and then is driven to be rotated to feed the document M to the document conveyance path 38A. The feed belt 42A and the separation roller 42B are disposed on the downstream side of the pickup roller 41. The separation roller 42B comes into contact with the feed belt 42A from below, and the document M fed by the pickup roller 41 is conveyed while being held between the feed belt 42A and the separation roller 42B. Even if two or more of the documents M are fed by the pickup roller 41, the conveyance speed of the document M other than the uppermost document is reduced by the frictional force with the separation roller 42B, and the uppermost document M is conveyed earlier. That is, the separation roller 42B prevents the multi feeding of the document M. The pair of registration rollers 43 is disposed on the downstream side of the separation roller 42B, and the conveyance roller 44 is disposed on the downstream side of the pair of registration rollers 43 and on the upstream side of the contact glass 30 (the document conveyance surface 30A).

The discharge part 45 has a conveyance guide 46 constituting the document conveyance path 38A on the downstream side of the contact glass 30. The pair of discharge rollers 47 is disposed on the downstream end portion of the conveyance guide 46. The upstream end portion of the conveyance guide 46 is supported in a turnable manner around a turning shaft 48 in the upper-and-lower direction. The turning shaft 48 is also used as a rotating shaft of the driven roller 44A coming into contact with the conveyance roller 44.

[Image reading Process]

With reference to FIG. 1 and FIG. 2, an operation of the image reading device 1B will be described. The document M set on the supply tray 36 is formed into a sheet-like shape. On the other hand, the document M set on the platen glass 31 (the document placement surface 31A) is not limited to a sheet, and may be a booklet, a card or the like.

First, a case where the document M is set on the supply tray 36 in a state where the holding part main body 35A (the document holding part 35) is closed will be described. When the user sets the document M (or the bundle of the documents M) on the supply tray 36 and inputs a reading instruction, the controller 14 controls the image reading device 1B and performs the image reading process as follows.

The pickup roller 41 feeds the document M set on the supply tray 36 to the document conveyance path 38A, and the feed belt 42A and the separation roller 42B feeds the document M to the downstream one by one. The pair of registration rollers 43 adjusts a timing at which the document M is fed to the contact glass 30 (the document conveyance surface 30A). The conveyance roller 44 is driven to be rotated to send the document M between the contact glass 30 and the holding member 35B. The document M is conveyed while being held on the contact glass 30 (the document conveyance surface 30A) by the holding member 35B. The optical scanning unit 32 irradiates the document M being conveyed on the document conveyance surface 30A with the light, and the light reflected on the document M is received by the image sensor 34 to be converted into an electric signal. Then, the image of the document M is read as the image data. The pair of discharge rollers 47 sends (discharges) the document M passed the contact glass 30 (the document conveyance surface 30A) to the discharge tray 37.

Next, a case where the holding part main body 35A (the document holding part 35) is opened and the document M is set on the platen glass 31 will be described. When a reading instruction is input from the user, the optical scanning unit 32 irradiates the document M on the platen glass 31 (the document placement surface 31A) with the light while moving rightward. The light reflected on the document M is received to the image sensor 34 and converted into the electric signal, whereby the image of the document M is read as the image data.

The image data read in the above-described manner is stored in the storage part 27 of the controller 14, and the controller 14 performs the image forming process (printing) described above. The image data may be stored in an external terminal without being printed.

[Lifting and Lowering Part]

The document conveyance device 16 includes a lifting and lowering part 50 which lifts and lowers the supply tray 36 and the discharge part 45 depending on the thickness (the height) of the bundle of documents M placed on the supply tray 36. By lifting and lowering the supply tray 36 and the discharge part 45, a large number of the document M can be placed on the supply tray 36, and a large number of the document M can be discharged on the discharge tray 37.

Hereinafter, with reference to FIG. 2 and FIG. 3, the lifting and lowering part 50 of the document conveyance device 16 will be described. FIG. 3 is a block diagram showing the controller 14 and the others of the document conveyance device 16.

As shown in FIG. 2, the lifting and lowering part 50 includes a lifting and lowering mechanism 51, a first detection part 52, a second detection part 53, a third detection part 54 and the controller 14 (see FIG. 3). The controller 14 is a component of the image forming apparatus 1, but is also a component of the lifting and lowering part 50.

<Lifting and Lowering Mechanism>

The lifting and lowering mechanism 51 has a function of lifting and lowering the supply tray 36 and the discharge part 45 by the same height in an interlocking manner. The lifting and lowering mechanism 51 lifts and lowers the supply tray 36 and the discharge part 45 between the lowermost position (see FIG. 2) and the uppermost position (see FIG. 5). As shown in FIG. 2, the lifting and lowering mechanism 51 includes a rack 60, a pinion 61, a lifting motor 62 and a link member 63. Although the rack 60, the pinion 61 and the link member 63 are provided in pairs on both front and rear sides of the conveyance mechanism part 40, only one of the pair is shown in the drawings.

The rack 60 is fixed to the side portion of the frame (not shown) of the conveyance mechanism part 40. The pinion 61 is supported on the side portion of the downstream side tray 36A in a rotatable manner around an axis. The pair of right and left pinions 61 are connected by a shaft (not shown). One pinion 61 is connected to the output shaft of the lifting motor 62 via a power transmission mechanism such as a gear train. For example, the rack 60 is formed in an approximately inverted U-shape having internal teeth, and the pinion 61 is meshed with the internal teeth of the rack 60. The lifting motor 62 is electrically connected to the controller 14 via a drive circuit (not shown). The pinion 61 is driven by the lifting motor 62 to be rotated, and is moved in the upper-and-lower direction while meshing with the rack 60.

The link member 63 is installed between the discharge part 45 and the downstream side tray 36A. Specifically, the link member 63 is disposed between the end portion of the upper roller of the pair of discharge rollers 47 and the side portion of the downstream side tray 36A. Both the upper and lower end portions of the link member 63 are rotatably supported by the rotating shaft of the roller and a connecting shaft projected on the downstream side tray 36A.

<First Detection Part>

The first detection part 52 is composed of, for example, a reflection type optical sensor (a distance sensor), and is provided on the supply tray 36. Specifically, the first detection part 52 is provided on the lower surface of the downstream side tray 36A with the light receiving part and the light emitting part facing downward. The first detection part 52 detects a distance between the uppermost document M stacked on the discharge tray 37 and the supply tray 36.

<Second Detection Part>

The second detection part 53 is provided in the downstream end portion of the discharge part 45. The second detection part 53 includes a turning member 65 and a turning detection part 66.

The turning member 65 is formed into a rod-like shape, and one end portion of the turning member 65 is supported by the turning detection part 66 in a rotatable manner. The turning member 65 is disposed so as to be able to comes into contact with the document M discharged from the discharge part 45. The turning member 65 is lifted by the discharged document M and lowered (returned) by its own weight after the passage of the document M. The turning detection part 66 is, for example, a transmission type optical sensor including a light emitting part and a light receiving part disposed on both the sides of the turning member 65. The turning member 65 described above is disposed so as to block the optical path from the light emitting part to the light receiving part in an initial state, for example, and is deviated from the optical path when lifted by the discharged document M. That is, when the receiving part receives the light emitted from the light emitting part, the turning detection part 66 detects that the document M passes through the discharge part 45. In other words, the second detection part 53 detects a number of the documents M discharged on the discharge tray 37. The one end portion of the turning member 65 may be supported by the rotating shaft of the roller in a rotatable manner. The turning member 65 may be provided so as to be deviated from the optical path in the initial state and to block the optical path when lifted by the discharged document M. And, the turning detection part 66 may detect that the document M passes through the discharge part 45 when the turning member 65 blocks the optical path.

<Third Detection Part>

The third detection part 54 is composed of, for example, a transmission type optical sensor, and is provided in the conveyance part 38 (the frame of the conveyance mechanism part 40). The third detection part 54 is disposed in a middle position between the lowermost position and the uppermost position of the supply tray 36. As described later in detail, when the supply tray 36 is disposed at a taking out position P1 set between the lowermost position and the uppermost position of the supply tray 36, the light blocking member 36D protruded on the downstream end portion of the supply tray 36 is positioned between the light emitting part and the light receiving part of the third detection part 54. When the light emitted from the light emitting part is blocked, the third detection part 54 detects that the supply tray 36 is positioned at the taking out position P1. The shape of the light blocking member D may be changed so as to block the light emitted from the light emitting part when the supply tray 36 is positioned at the taking out position P1 (this example is not shown).

As shown in FIG. 3, the first detection part 52, the second detection part 53 (the turning detection part 66) and the third detection part 54 are electrically connected to the controller 14 via respective control circuits. The detection results (the electric signals) of the detection parts 52 to 54 are transmitted to the controller 14.

[Control of Lifting and Lowering Part]

Figure 4:
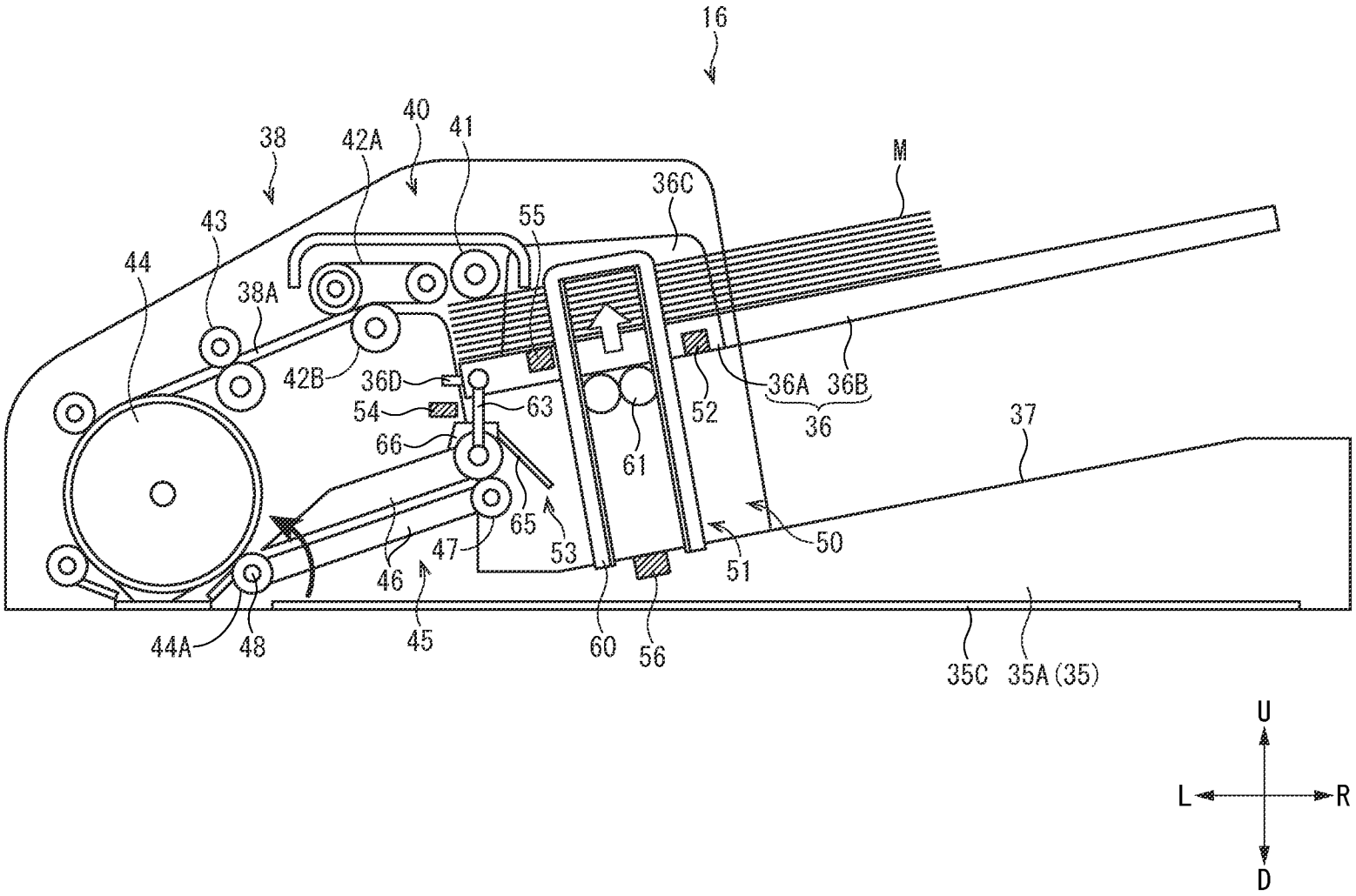
FIG. 4 is a sectional view showing the document conveyance device according to the first embodiment of the present disclosure, in a state where the uppermost document is pressed on a pickup roller.
Figure 5:
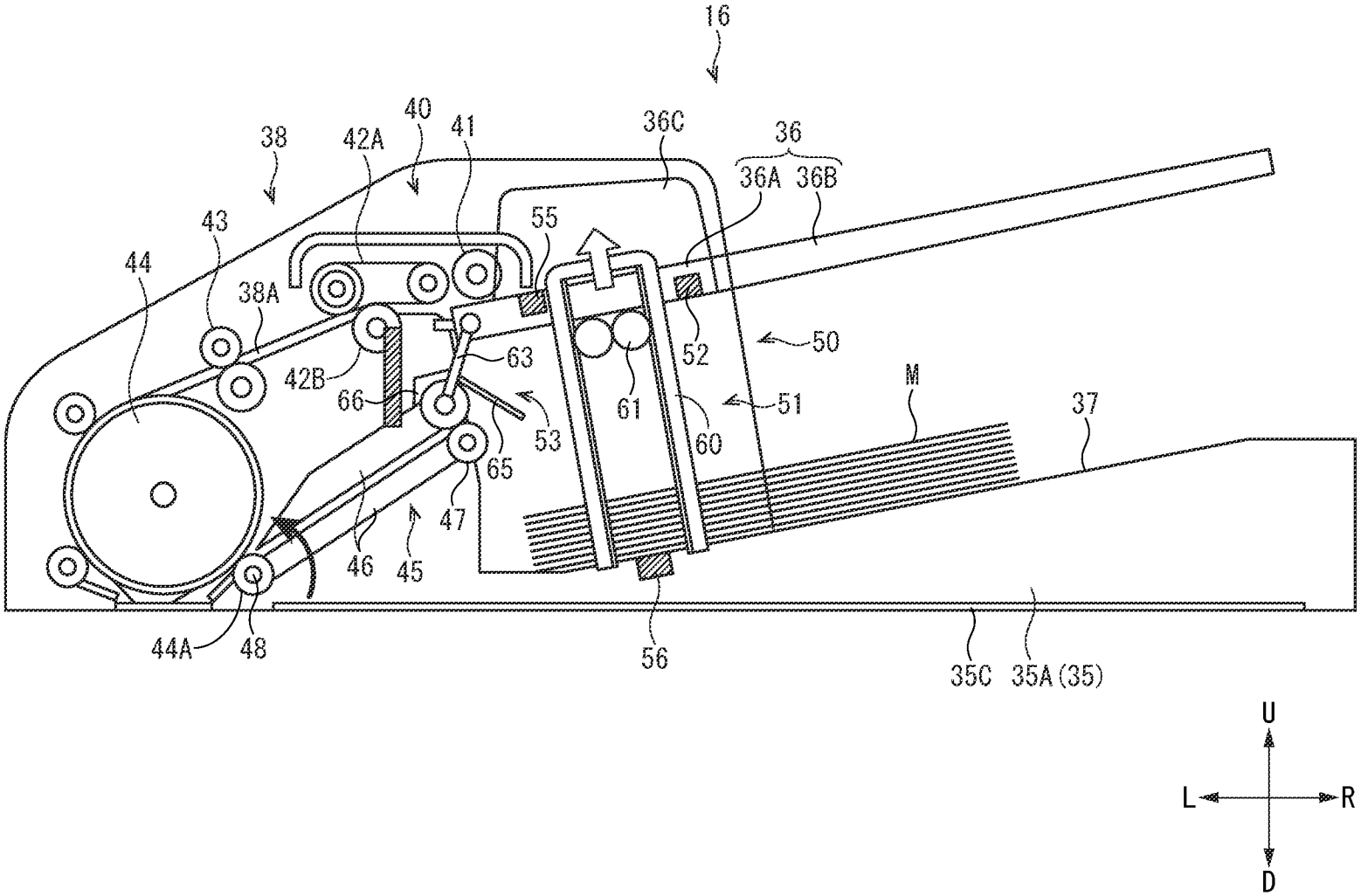
FIG. 5 is a sectional view showing the document conveyance device according to the first embodiment of the present disclosure, in a state where the supply tray is lifted to the uppermost position.
Figure 6:
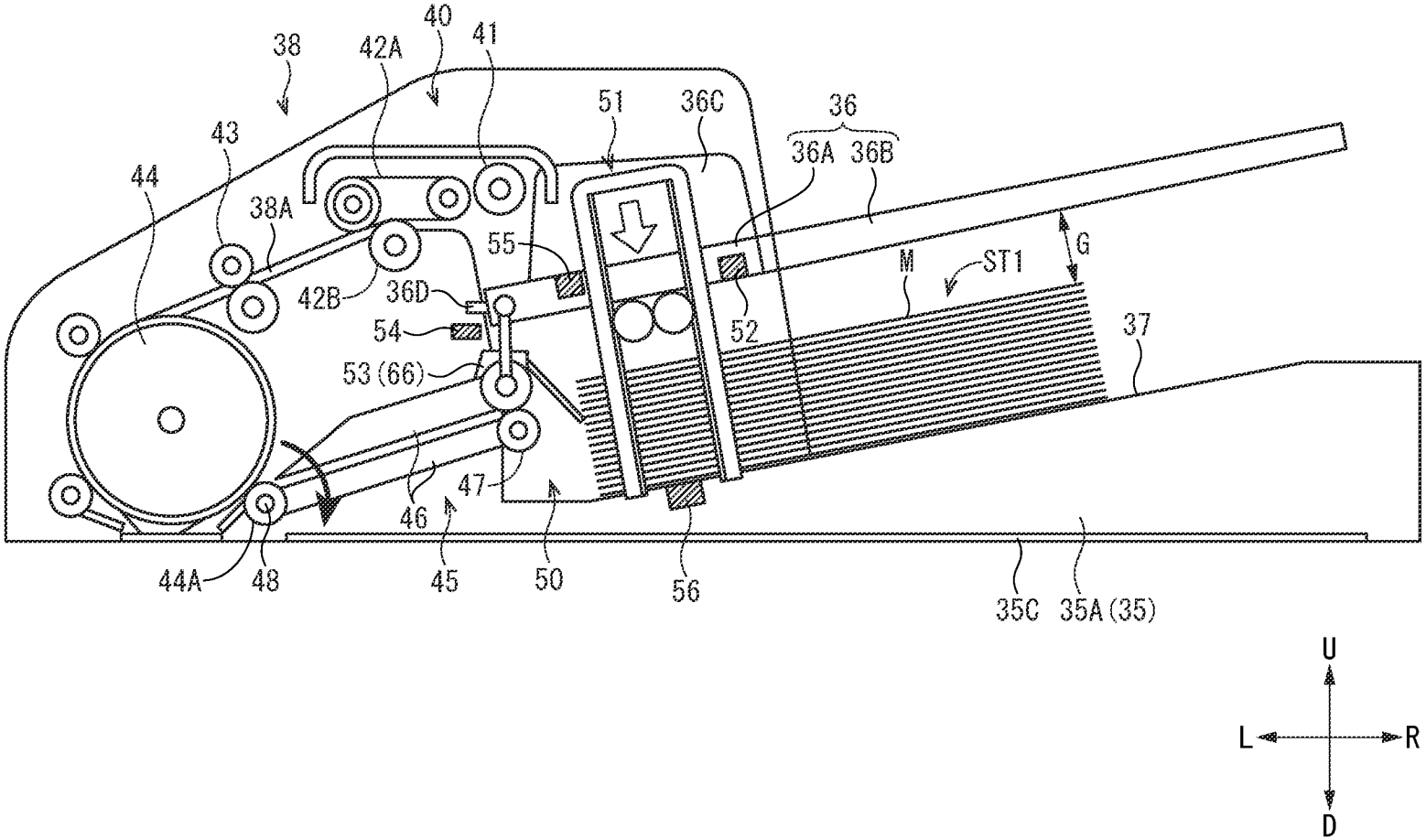
FIG. 6 is a sectional view showing the document conveyance device in a large number of documents discharge state, according to the first embodiment of the present disclosure.
Figure 7:
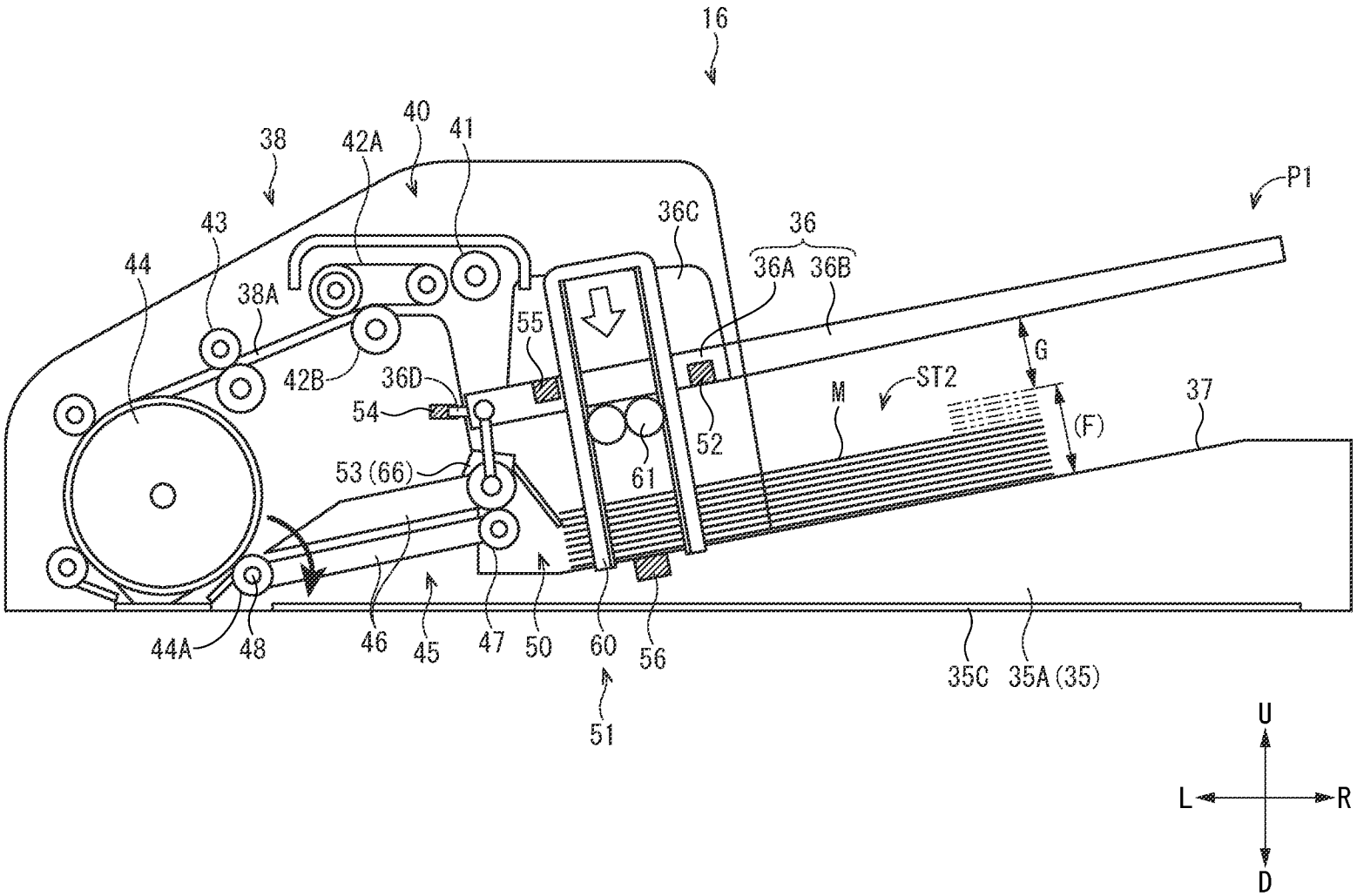
FIG. 7 is a sectional view showing the document conveyance device in a small number of documents discharge state, according to the first embodiment of the present disclosure.
Figure 8:
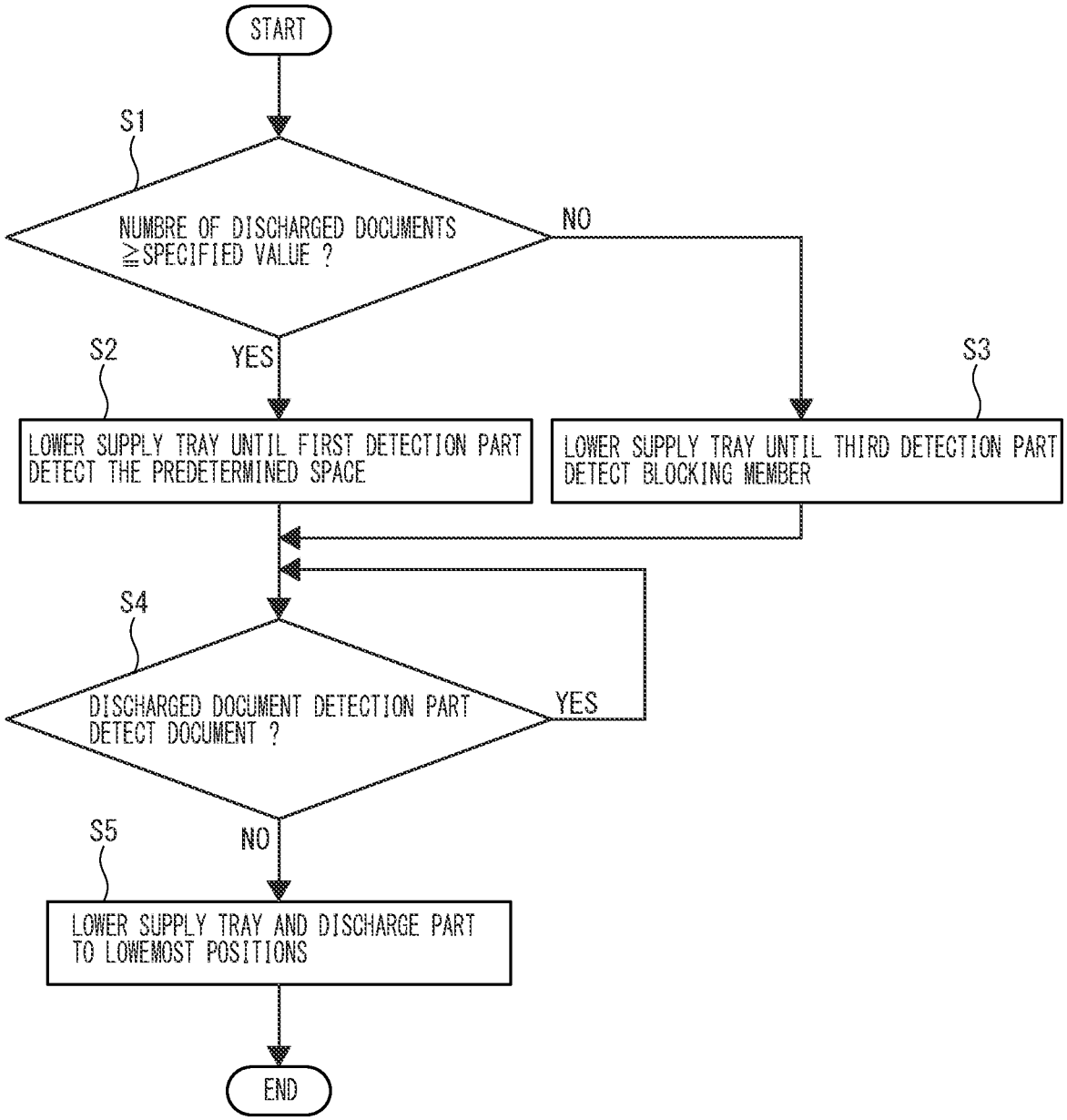
FIG. 8 is a flowchart showing a control of a lifting and lowering mechanism of the document conveyance device according to the first embodiment of the present disclosure.

Next, with reference to FIG. 2, and FIG. 4 to FIG. 8, the control of the lifting and lowering part 50 will be described. FIG. 4 is a sectional view showing a state where the uppermost document M is pressed on the pickup roller 41. FIG. 5 is a sectional view showing a state where the supply tray 36 is lifted to the uppermost position. FIG. 6 is a sectional view showing a large number of documents discharge state ST1. FIG. 7 is a sectional view showing a small number of documents discharge state ST2. FIG. 8 is a flowchart showing the control of the lifting and lowering part 50.

In an initial state before the document M is placed (set) on the supply tray 36, the supply tray 36 and the discharge part 45 are positioned at the respective lowermost positions (see FIG. 2). The document conveyance device 16 is provided with a sensor (not shown) which detects the supply tray 36 (or the discharge part 45) is positioned at the lowermost position, and the supply tray 36 and the others are controlled so as to be stopped at the lowermost positions. On the supply tray 36 positioned at the lowermost position, 500 sheets of the documents M (a plain paper) can be placed at the maximum. The maximum number of the documents M placeable on the supply tray 36 may be suitably changed.

<Control of Lifting and Lowering Part During Image Reading Process>

When the supplied document detection part 55 detects that the documents M are placed on the supply tray 36 and the user inputs the reading instruction of the document M, the controller 14 drives the lifting motor 62 to lift the supply tray 36 from the lowermost position and to press the uppermost document M on the pickup roller 41 (see FIG. 4). Thereafter, the image reading process described above is performed. Whether the uppermost document M is pressed on the pickup roller 41 is detected by an upper limit detection switch (not shown) provided in the pickup roller 41 or near the pickup roller 41. The detection signal of the upper limit switch is monitored by the controller 14 during a period where the documents M placed on the supply tray 36 are fed. With the lifting of the supply tray 36, the discharge part 45 is turned upward around the turning shaft 48 to be lifted from the lowermost position.

The lifting and lowering part 50 (the lifting and lowering mechanism 51) lifts the supply tray 36 and the discharge part 45 depending on the feeding of the documents M (see the white blank arrow and the thick solid arrow in FIG. 4). That is, when the documents M are fed and the thickness of the bundle of documents M becomes thin (lower), the controller 14 lifts the supply tray 36 until the upper limit switch detects the document M. The controller 14 gradually lifts the supply tray 36 until all the documents M placed on the supply tray 36 are fed (until the supplied document detection part 55 no longer detects the document M) (see FIG. 5). The second detection part 53 detects the document M discharged from the discharge part 45 to the discharge tray 37, and the controller 14 stores a value obtained by integrating the detection results of the second detection part 53 (the number of the discharged documents M) in the storage part 27.

When the feeding of the documents M to the document conveyance path 38A is completed (the supplied document supply part 55 no longer detects the document M) and the second detection part 53 detects the discharging of the last document M, the image reading process is completed (see FIG. 5). At the time of the completion of the image reading process, the supply tray 36 is positioned at the uppermost position (or near the uppermost position) (see FIG. 5). The document conveyance device 16 is provided with a sensor (not shown) which detects that the supply tray 36 is disposed at the uppermost position, and the supply tray 36 is controlled to be stopped at the uppermost position.

<Control of Lifting and Lowering Part after Completion of Image Reading Process>

After the image reading process is completed, the controller 14 estimates a height of the documents M stacked on the discharge tray 37 from the detection result of the second detection part 53 (the number of the documents M). Specifically, the controller 14 (the lifting and lowering part 50) determines whether it is a large number of documents discharge state ST1 or a small number of documents discharge state ST2 based on the detection result of the second detection part 53. The large number of documents discharge state ST1 shows a state where the height of the documents M stacked on the discharge tray 37 is more than a specified value (F). The small number of documents discharge state ST2 shows a state where the height of the documents M stacked on the discharge tray 37 is less than the specified value (F). "The specified value (F)" indicates, for example, a height at which 320 sheets of the documents M are stacked, and the specified value (F) is obtained experimentally in advance and stored in the storage part 27. Therefore, as shown in FIG. 8, the controller 14 compares the number of the documents M stored in the storage part 27 with the specified value (F) based on the detection result of the second detection part 53 (step S1). The number of sheets of the documents M indicating the specified value (F) is not limited to 320 sheets, and can be freely set, for example, according to the maximum distance between the supply tray 36 and the discharge tray 37.

In the large number of documents discharge state ST1 (the number of sheets of the documents M the specified value (F)) (YES in S1), the controller 14 (the lifting and lowering part 50) lifts the supply tray 36 at a height above the uppermost document M by a predetermined space G (step S2). Specifically, the controller 14 drives the lifting motor 62 to lower the supply tray 36 until the first detection part 52 detects the predetermined space G (see FIG. 6). When the first detection part 52 detects the predetermined space G, the controller 14 stops the lifting motor 62. That is, in the large number of documents discharge state ST1, the lifting and lowering part 50 controls the height of the supply tray 36 based on the detection result of the first detection part 52. The predetermined space G is a space such that the supply tray 36 does not interfere with the uppermost document M, and is, for example, a space of several mm to several tens mm. When 500 sheets of the documents M are discharged, the supply tray 36 may be held at the uppermost position without being lowered. That is, in the state where 500 sheets of the documents M are stacked on the discharge tray 37, the predetermined space G (or more) is formed between the uppermost document M and the supply tray 36 positioned at the uppermost position.

On the other hand, in the small number of documents discharge state ST2 (the number of sheets of the documents M<the specified value (F)) (NO in S1), the controller 14 (the lifting and lowering part 50) lowers the supply tray 36 at a taking out position P1 depart upward from the specified value (F) by the predetermined space (G) (step S3). Specifically, the controller 14 drives the lifting motor 62 to lower the supply tray 36 until the third detection part 54 detects the light blocking member 36D (the light blocking member 36D blocks the optical path) (see FIG. 7). When the third detection part 54 detects the light blocking member 36D, the controller 14 stops the lifting motor 62. That is, in the small number of documents discharge state ST2, the third detection part 54 detects the supply tray 36 positioned at the taking out position P1, and the lifting and lowering part 50 controls the height of the supply tray 36 based on the detection result of the third detection part 54. The taking out position P1 is a position where the user can easily enter his hand into the space between the supply tray 36 and the discharge tray 37, and can be obtained experimentally. The height of the supply tray 36 in the large number of documents discharge state ST1 is set to be equal to or higher than the taking out position P1.

In the large number of documents discharge state ST1, since the bundle of documents M stacked on the discharge tray 37 is thick (high), the space between the supply tray 36 and the discharge tray 37 is sufficiently wide (see FIG. 6). Therefore, the user can easily take out the document M by entering his hand into the space between the supply tray 36 and the discharge tray 37. On the other hand, in the small number of documents discharge state ST2, since the supply tray 36 is held at least at the specified value (F) (the taking out position P1), the user can easily enter his hand into the space between the supply tray 36 and the discharge tray 37 (see FIG. 7). Therefore, the user can easily take out the documents M.

Next, the controller 14 determines whether the documents M exist on the discharge tray 37 based on the detection result of the discharged document detection part 56 (step S4). When the documents M exist on the discharge tray 37 (the discharged document detection part 56 still detects the documents M) (YES in S4), the controller 14 (the lifting and lowering part 50) positions the supply tray 36 at a position higher than the taking out position P1. That is, the controller 14 does not drive the lifting motor 62 to keep the supply tray 36 at the current position.

When the discharged document detection part 56 that has detected the documents M no longer detects the documents M (NO in S4), the controller 14 (the lifting and lowering part 50) lowers the supply tray 36 to the lowermost position and lowers the discharge part 45 to the lowermost position (step S5). Specifically, the controller 14 drives the lifting motor 62 to lower the supply tray 36 to the lowermost position. The discharge part 45 is lowered to the lowermost position with the lowering of the supply tray 36. Thereby, the supply tray 36 and the discharge part 45 are positioned at the respective lowermost positions (see FIG. 2).

The document conveyance device 16 according to the first embodiment described above has a configuration that in the small number of documents discharge state ST2, the lifting and lowering part 50 positions the supply tray 36 at the taking out position P1 depart upward from the specified value (F) by the predetermined space G. According to the configuration, even if the number of sheets of the discharged documents M is small, it becomes possible to restrict the lowering of the supply tray 36. Therefore, even in the configuration that the supply tray 36 is lifted and lowered, it becomes possible to take out a small number of sheets of the documents M easily. Further, by lowering the supply tray 36, it becomes possible to place the document M to be read next time on the supply tray 36.

According to the document conveyance device 16 of the first embodiment, the second detection part 53 detects the number of sheets of the documents M stacked on the discharge tray 37, so that it becomes possible to estimate the height of the documents M and it becomes possible to correctly determine whether the state of the discharge tray 37 is in the large number of documents discharge state ST1 or the small number of documents discharge state ST2. Furthermore, the first detection part 52 detects the distance between the uppermost document M and the supply tray 36, so that it becomes possible to position the supply tray 36 at a position where the supply tray 36 does not interfere with the uppermost document M. Furthermore, the supply tray 36 is moved such that the third detection part 54 detects the supply tray 36, so that it becomes possible to position the supply tray 36 at the taking out position P1.

According to the document conveyance device 16 of the first embodiment, while the documents M are stacked on the discharge tray 37, the discharged document detection part 56 continuously detects the documents M, so that it becomes possible to separate the supply tray 36 from the discharge tray 37 and to take out the documents M from the discharge tray 37 easily. On the other hand, when the document M is taken out from the discharge tray 37, the discharged document detection part 56 no longer detects the documents M, so that it becomes possible to return the supply tray 36 and the others to their lowermost positions. Then, it becomes possible to set the document M to be read next time on the supply tray 36.

[Second Embodiment]

Figure 9:
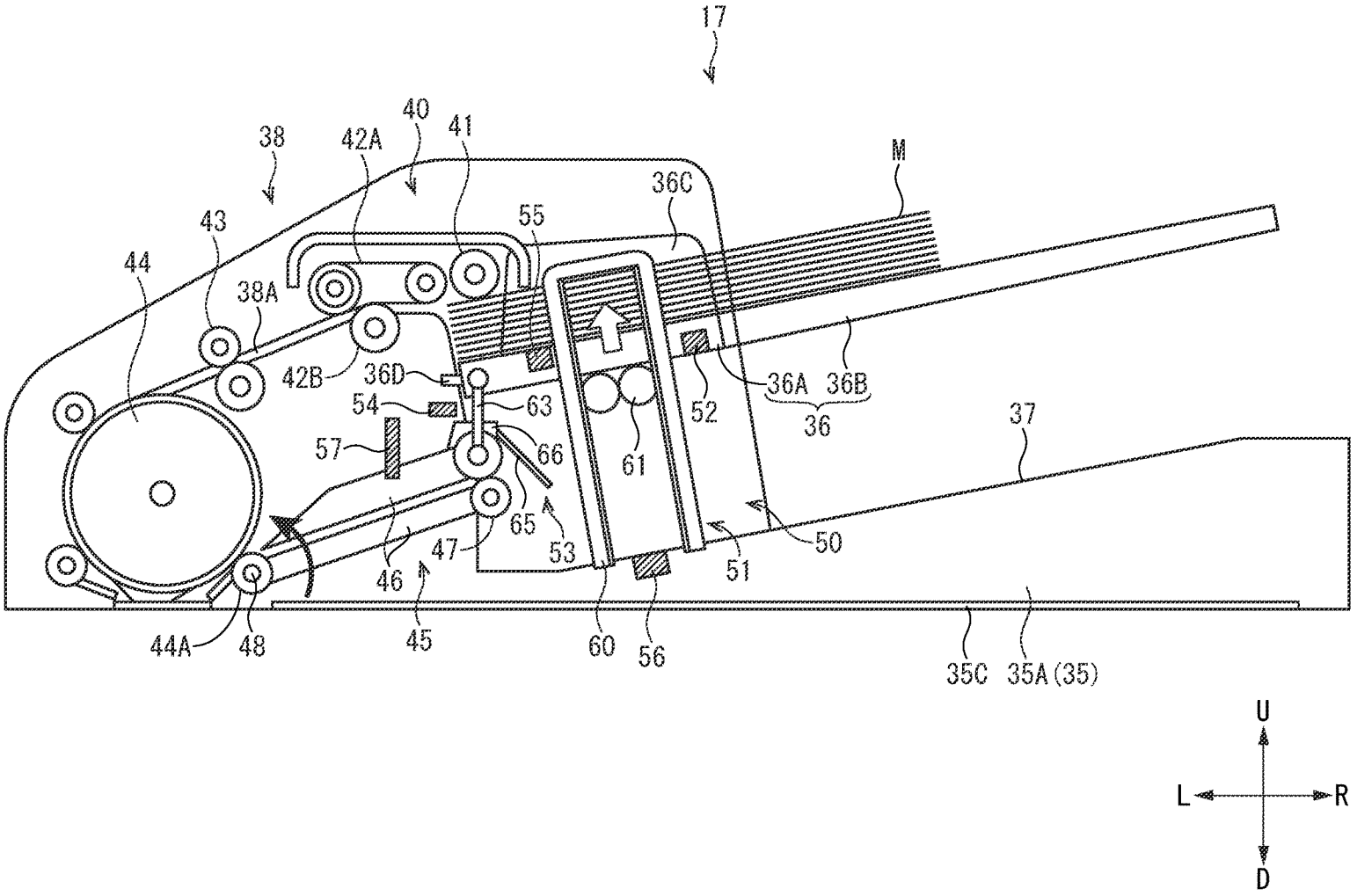
FIG. 9 is a sectional view showing the document conveyance device according to the second embodiment of the present disclosure, in a state where the uppermost document is pressed on the pickup roller.
Figure 10:
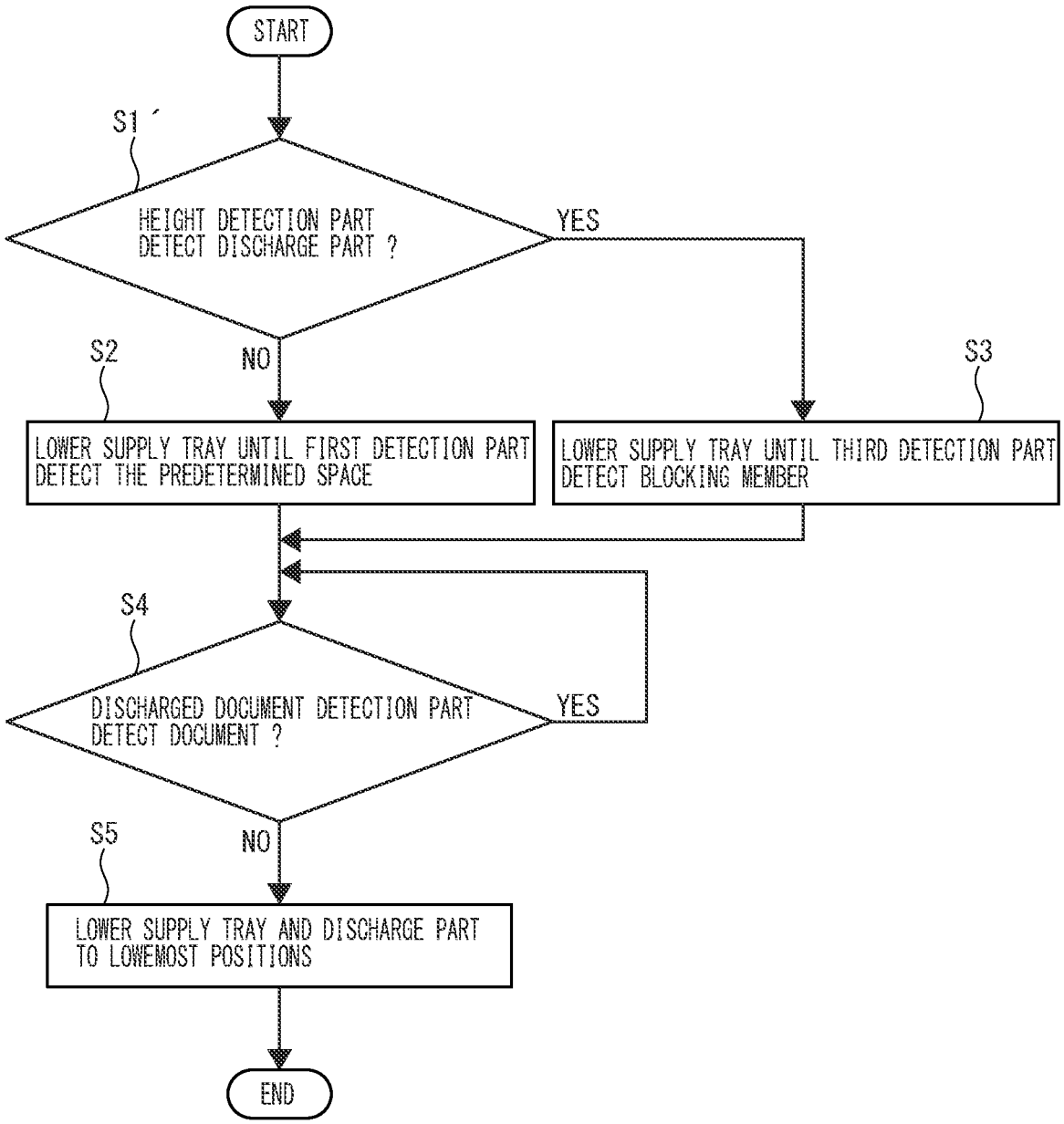
FIG. 10 is a flowchart showing a control of a lifting and lowering mechanism of the document conveyance device according to the second embodiment of the present disclosure.

Next, with reference to FIG. 9 and FIG. 10, the document conveyance device 17 according to the second embodiment will be described. FIG. 9 is a sectional view showing a state where the uppermost document M is pressed on the pickup roller 14. FIG. 10 is a flowchart showing a control of the lifting and lowering part 50. The same structures as (the structures corresponding to) the document conveyance device 16 of the first embodiment are marked with the same reference number, and the description of the same or corresponding to structures of the document conveyance device 16 are omitted.

As shown in FIG. 9, in the document conveyance device 17 according to the second embodiment, the lifting and lowering part 50 includes a height detection part 57 provided in the conveyance part 38 (the frame of the conveyance mechanism part 40). The height detection part 57 is, for example, a transmission type optical sensor, and detects a height of the discharge part 45. The height detection part 57 is electrically connected to the controller 14 via a control circuit or the like, and the controller 14 receives the detection result (an electric signal) of the height detection part 57. The document conveyance device 17 according to the second embodiment includes the second detection part 53.

Specifically, the height detection part 57 detects a height of the discharge part 45 (the conveyance guide 46) when the supply tray 36 is lifted from the lowermost position to press the uppermost document M on the pickup roller 41 at the start time of the image reading process. When less than 320 sheets of the documents M are placed on the supply tray 36, at the start time of the image reading process, the discharge part 45 (the conveyance guide 46) is positioned between the light emitting part and the light receiving part of the height detection part 57, and the light emitted from the light emitting part is blocked. When the detection result of the height detection part 57 is received, the controller 14 estimates that less than 320 sheets of the documents M placed on the supply tray 36 will be discharged to the discharge tray 37. The detection result of the height detection part 57 is stored in the storage part 27. The discharge part 45 may be provided with a blocking member so as to separate from the space between the light emitting part and the light receiving part of the height detection part 57 when less than 320 sheets of the documents M are placed on the supply tray 36 (this example is not shown).

<Control of Lifting and Lowering Part at Completion of Image Reading Process>

As shown in FIG. 10, after the image reading process is completed, the controller 14 (the lifting and lowering part 50) determines whether it is in the large number of documents discharge state ST1 or the small number of documents discharge state ST2 based on the detection result of the height detection part 57 (the detection result stored in the storage part 27) (step S1'). That is, when the height detection part 57 does not detects the discharge part 45 (NO in step S1'), the controller 14 determines that it is in the large number of document discharge state ST1, and when the height detection part 57 detects the discharge part 45 (YES in step S1'), the controller 14 determines that it is in the small number of documents discharge state ST2. The processes after step S1' are the same as the steps of the lifting and lowering part 50 of the document conveyance device 16 according to the first embodiment, and their descriptions are omitted.

According to the document conveyance device 17 of the second embodiment described above, even if the number of sheets of the discharged documents M is small, the same effects as the first embodiment can be obtained, for example, it becomes possible to restrict the lowering of the supply tray 36 and for the user to take out the documents M on the discharge tray 37 easily. Further, the height detection part 57 detects the height of the discharge part 45 so that it becomes possible to correctly determine whether the state of the discharge tray 37 is in the large number of document discharge state ST1 or in the small number of document discharge state ST2.

The document conveyance devices 16 and 17 according to the first and the second embodiments are configured such that the supply tray 36 and the discharge tray 37 are coupled to each other by the link member 63 so as to be liftable and lowerable by the lifting and lowering mechanism 51, but the present disclosure it not limited to the configuration. The lifting and lowering part 50 may include a mechanism for lifting and lowering the supply tray 36 and another mechanism for lifting and lowering the discharge tray 37 separately (this example is not shown).

The document conveyance devices 16 and 17 according to the first and the second embodiments are configured such that the lifting and lowering mechanism 51 includes the rack 60 and the pinion 62, but the present disclosure is not limited to the configuration. For example, the lifting and lowering mechanism 51 may include a pulley and a wire, or a piston and cylinder (this example is not shown).

In the document conveyance devices 16 and 17 according to the first and the second embodiments, the first detection part 52 is a reflection type optical sensor, but it is not limited thereto, and may be, for example, a laser range meter or an ultrasonic range meter (not shown). Although the second detection part 53 includes the turning member 65 which blocks the optical path of the turning detection part 66, the present disclosure is not limited thereto. For example, the second detection part 53 may include a microswitch pressed by the turned turning member 65, or may be composed only of a sensor for optically detecting the document M (these examples are not shown). Although the third detection part 54 is a transmission type optical sensor, the present disclosure is not limited thereto. For example, the third detection part 54 may be a reflection type optical sensor which detects the supply tray 36 disposed at the taking out position P1, or a microswitch pressed by the supply tray 36 disposed at the taking out position P1 (these examples are not shown). Further, although the height detection part 57 is a transmission type optical sensor, the present disclosure is not limited thereto. For example, the height detection part 57 may be a reflection type optical sensor which detects the discharge part 45 that has lifted to the predetermined position, a microswitch pressed by the discharge part 45 that has lifted to the predetermined position, an angle sensor which detects the rotation angle of the discharge part 45, or the like (not shown).

Further, in the document conveyance device 16 according to the first embodiment, the second detection part 53 detects the number of sheets of the documents M discharged to the discharge tray 37, and estimates the height of the documents M on the discharge tray 37. In the document conveyance device 17 according to the second embodiment, the height detection part 57 detects the height of the discharge part 45, and estimates the height of the document M on the discharge tray 37. However, the present disclosure is not limited thereto. For example, an optical sensor or an ultrasonic sensor which directly detects that the height of the document M stacked on the discharge tray 37 reaches the specified value (F) may be provided (these examples are not shown).

In the document conveyance devices 16 and 17 according to the first and the second embodiments, the lifting and lowering part 50 is controlled by the controller 14 provided in the image forming apparatus 1, but a dedicated controller for controlling the lifting and lowering part 50 may be provided separately from the controller 14 (this example is not shown).

Further, in the description of the present embodiment, the case where the present invention is applied to the image forming apparatus 1 (the multifunction peripheral) is shown as an example, but the present invention is not limited thereto, and the present invention may be applied to, for example, a copying machine, a facsimile machine, an image reading dedicated machine, or the like.

The description of the above embodiment shows one aspect of the document conveyance device, the image reading device, and the image forming apparatus according to the present invention, and the technical range of the present invention is not limited to the above embodiment. The present disclosure may be modified, substituted, or changed in various ways without departing from the spirit of the technical idea, and the claims include all embodiments which may be included within the scope of the technical idea.

The invention claimed is:

1. A document conveyance device comprising:

a supply tray on which a document is placed;

a discharge tray disposed below the supply tray;

a conveyance part which feeds the document on the supply tray to a document conveyance path one by one and conveys the document along the document conveyance path;

a discharge part which discharges the document conveyed by the conveyance part to the discharge tray; and a lifting and lowering part which lifts and lowers the supply tray and the discharge part, wherein the lifting and lowering part lifts the supply tray and the discharge part according to a feeding of the document, when the feeding of the document to the document conveyance path is completed and then the supply tray is lifted, in a large number of documents discharge state where a height of the documents stacked on the discharge tray is more than a specified value, the lifting and lowering part positions the supply tray at a taking out position depart upward from an uppermost document of the documents stacked on the discharge tray by a predetermined space, when the feeding of the document to the document conveyance path is completed and then the supply tray is lifted, in a small number of documents discharge state where the height of the documents stacked on the discharge tray is less than the specified value, the lifting and lowering part positions the supply tray at a taking out position depart upward from the specified value by the predetermined space.

2. The document conveyance device according to claim 1, wherein the lifting and lowering part includes:

a first detection part which is provided in the supply tray and detects a distance between the uppermost document on the discharge tray and the supply tray;

a second detection part which is provided in the discharge part and detects a number of sheets of the documents discharged on the discharge tray; and a third detection part which is provided in the conveyance part and detects the supply tray disposed at the taking out position, wherein the lifting and lowering part determines whether it is in the large number of document discharge state or the small number of documents discharge state, based on a detection result of the second detection part, in the large number of documents discharge state, the lifting and lowering part controls a height of the supply tray based on a detection result of the first detection part, and in the small number of documents discharge state, the lifting and lowering part controls the height of the supply tray based on a detection result of the third detection part.

3. The document conveyance device according to claim 1, further comprising a discharged document detection part which detects the documents stacked on the discharge tray, wherein while the discharged document detection part detects the document, the lifting and lowering part positions the supply tray at a position higher than the taking out position, and when the discharged document detection part that has detected the document no longer detects the document, the lifting and lowering part lowers the supply tray to a lowermost position and lowers the discharge part to a lowermost position.

4. The document conveyance device according to claim 1, wherein the predetermined space is a space in which a user can enter his hand.

5. An image reading device comprising:

the document conveyance device according to claim 1; and a reading part which reads an image of the document conveyed along the document conveyance path by the conveyance part.

6. An image forming apparatus comprising the image reading device according to claim 5.

* * * * *